United States Patent [19]

Steinke

[11] Patent Number: 4,513,669

[45] Date of Patent: Apr. 30, 1985

[54] SHELVING STRUCTURE AND CLIP USED THEREIN

[75] Inventor: Mark H. Steinke, Montgomery, Ill.

[73] Assignee: Lyon Metal Products, Incorporated, Aurora, Ill.

[21] Appl. No.: 455,195

[22] Filed: Jan. 3, 1983

[51] Int. Cl.[3] ..... A47B 3/00

[52] U.S. Cl. ..... 108/111; 108/108; 248/243

[58] Field of Search ..... 248/243; 211/187; 108/108, 111

[56] References Cited

U.S. PATENT DOCUMENTS

| | | | |
|---|---|---|---|
| 3,306,466 | 2/1967 | Liston | 248/243 |
| 3,536,015 | 10/1970 | Textoris | 248/243 X |
| 4,405,052 | 9/1983 | Spiros | 248/243 X |

FOREIGN PATENT DOCUMENTS

| | | | |
|---|---|---|---|
| 255684 | 7/1967 | Austria | 248/243 |
| 41851 | 12/1969 | Finland | 211/187 |
| 556245 | 2/1957 | Italy | 211/187 |
| 358563 | 1/1962 | Switzerland | 211/187 |

*Primary Examiner*—James T. McCall

*Attorney, Agent, or Firm*—Emrich & Dithmar

[57] ABSTRACT

Shelving structure comprises a post having two flanges, a shelf having a top wall and side flanges, and several clips to attach each corner of each shelf to an associated post. Each clip has two perpendicular flanges, one pair of coplanar fingers extending from one flange and another pair of coplanar fingers extending from the other flange. Each finger carries a hook. The fingers are located in corresponding apertures in a post and the hook bears against the outer surface of the post. The shelf flanges fit between the clip and the associated post flanges.

20 Claims, 8 Drawing Figures

SHELVING STRUCTURE AND CLIP USED THEREIN

BACKGROUND OF THE INVENTION

Steel shelving has been widely used in commerce and industry. In order to rapidly be able to erect shelving, or quickly disassemble it, or to make modification by adding to or taking from the shelving, it has long been known that the shelving is desirably fastenerless. In other words, the components of the shelving should be assembled without the use of fasteners. But, at the same time, the interconnection between the components must be secure.

The present invention deals with an improved fastenerless shelving composed of steel or the like.

SUMMARY OF THE INVENTION

It is an important object of the present invention to provide shelving in which each shelf is supported on both sides of each corner.

Another object is to enable use of shelves having side flanges which are not welded together, yet perform as if they were so welded.

Another object is to provide steel shelving which utilizes steel of a lighter gauge than would be expected in view of the strength achieved thereby.

Another object is to provide sheet metal shelving in which the upright posts are maintained vertical and the shelves horizontal by means of a new and improved clip construction.

In summary, there is provided a clip for mounting a shelf on an upright post, the clip being of one-piece construction and comprising first and second flanges substantially perpendicular to each other, a pair of first fingers coplanar with the first flange and extending outwardly therefrom, a pair of first coplanar hooks carried respectively by the first fingers and being substantially perpendicular thereto, a pair of second fingers coplanar with the second flange and extending outwardly therefrom, and a pair of second coplanar hooks carried respectively by the second fingers and being substantially perpendicular thereto.

In a further aspect of the invention, there is provided shelving structure comprising the clip, an upright post including substantially perpendicular first and second post flanges, the first post flange having a first column of apertures, the second post flange having a second column of apertures, the apertures in the first column being respectively laterally aligned with corresponding apertures in the second column, each of the post flanges having an inside and an outside surface; the first fingers being respectively disposed within two of the first column of apertures, the first hooks facing the outside surface of the first post flange, the first clip flange having an edge spaced from and substantially parallel to the inside surface of the first post flange, the second fingers being respectively disposed within corresponding ones of the second column of apertures, the second hooks facing the outside surface of the second post flange, the second clip flange having an edge spaced from and substantially parallel to the inside surface of the second post flange; and a shelf including a substantially rectangular top wall and a pair of first shelf flanges depending from opposite sides of the top wall, and a pair of second flanges depending from the two remaining sides of the top wall, one of the first shelf flanges being disposed in the space between the first post flange and the clip and resting on one of the first fingers, and the adjacent second shelf flange being disposed in the space between the second post flange and the clip and resting on one of the second fingers.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
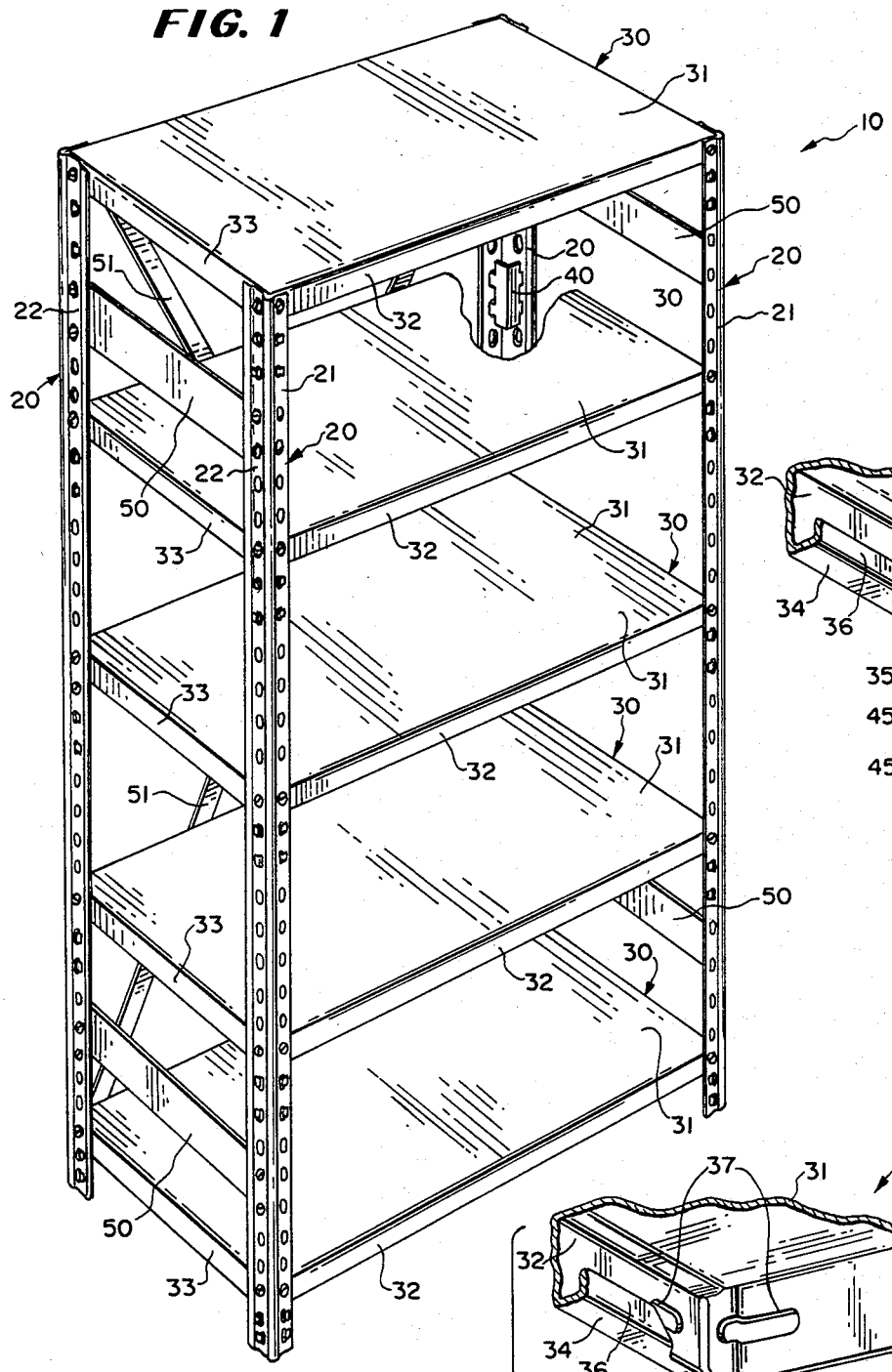
FIG. 1 is a perspective view of shelving structure incorporating the features of the present invention.

Referring now to FIG. 1, there is shown shelving structure generally designated by the numeral 10, constructed in accordance with and embodying the features of the present invention. The shelving structure 10 incorporates a set of four upstanding posts 20 supporting therebetween five shelves 30 by means of twenty clips 40, one of such clips being shown in FIG. 1. It is to be understood that the shelving structure 10 is merely representative and any plurality of posts 20 to support any number of shelves 30 with a multiplicity of the clips 40 can be utilized. Cross braces 50 may be employed to space and interconnect the front and rear posts, and diagonal braces 51 may be employed to space and interconnect the rear posts. All of the components depicted in FIG. 1 are constructed of sheet metal, preferably steel.

Figure 2:
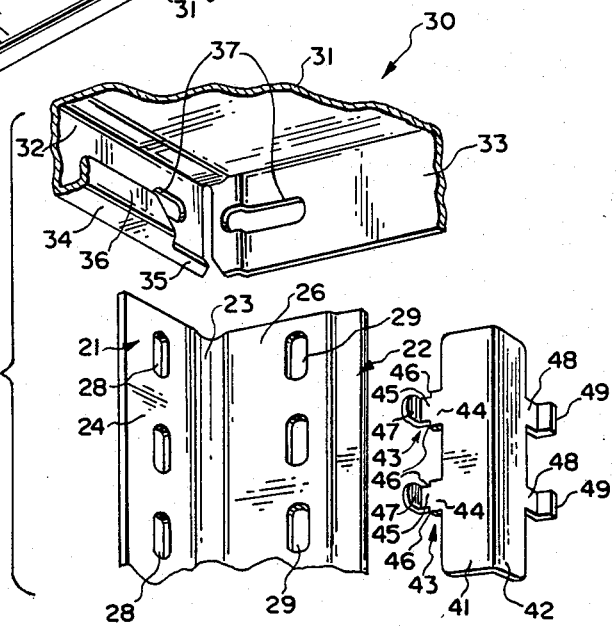
FIG. 2 an exploded view of the clip, a fragmentary portion of the post, and a fragmentary portion of the shelf, used in the shelving structure of FIG. 1.
Figure 7:
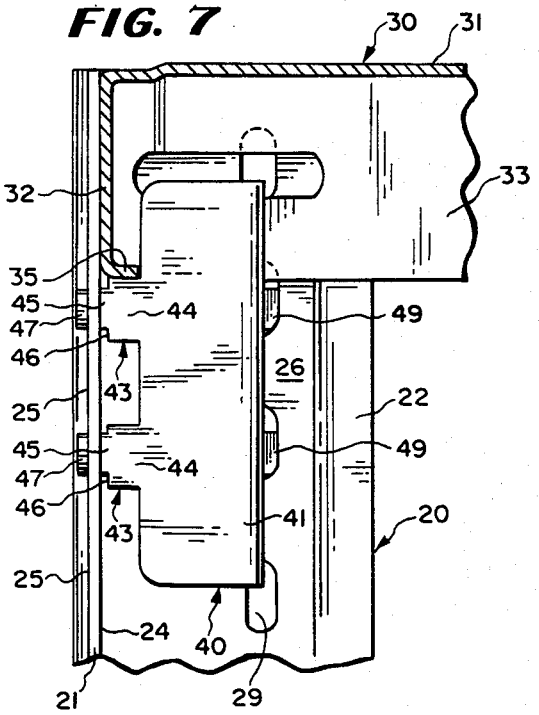
FIG. 7 is a view in vertical section taken along the line 7—7 of FIG. 6.
Figure 8:
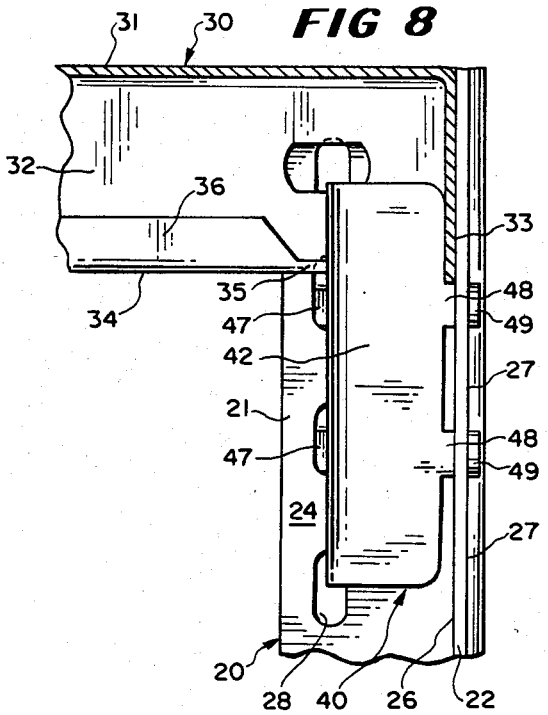
FIG. 8 is a view in vertical section taken along the line 8—8 of FIG. 6.

Referring to FIG. 2, each post 20 is of one-piece construction and includes flanges 21 and 22 intersecting at a rounded corner 23. The flange 21 has an inner surface 24 and an outer surface 25 (FIG. 7). Likewise, the flange 22 has an inner surface 26 and an outer surface 27 (FIG. 8). The flange 21 has a column of first apertures 28 and the flange 22 has a column of second apertures 29, the apertures 28 being respectively laterally aligned with corresponding apertures 29. Each of the apertures 28 and 29 in the particular form depicted is oblong or vertically elongated with rounded ends.

The shelf 30 is also of one-piece construction and includes a planar, substantially rectangular top wall 31 and four depending side flanges, the ones at the front and back being labelled 32 and the ones at the sides being labelled 33. Each of the flanges 32 carries an inturned lip 34 generally parallel to the top wall 31, the lip 34 being cut out adjacent each corner to provide a narrower lip 35. The lip 34 carries an upstanding rigidifying flange 36 disposed generally parallel to the flange 32. The holes 37 in the flanges 32 and 33, not pertinent to the present invention, may be used to attach the shelf with fasteners.

The shelving structure 10 further comprises a clip generally designated by the numeral 40. The clip 40, also of one-piece construction, includes flanges 41 and 42 substantially perpendicular to each other. A pair of longitudinally spaced-apart fingers 43 is coplanar with the flange 41 and extends outwardly therefrom. Each finger 43 has a wider body portion 44 extending from the flange 42 and a narrower neck portion 45 extending from the body portion 44. The outer edge of the body portion 44 unoccupied by the neck portion 45 defines two small shoulders 46. A hook 47 is carried by each neck portion 45 and is substantially perpendicular thereto, the hooks 47 being substantially coplanar and extending parallel to the flange 42 but in an opposite direction. A pair of second fingers 48 is coplanar with the flange 42 and extends outwardly therefrom. The fingers 48 are longitudinally spaced apart and are laterally respectively aligned with the fingers 43. The bottom surface of each neck portion 45 is at the same level as the bottom surface of the corresponding finger 48. Two coplanar hooks 49 are carried respectively by the fingers 48 and are substantially perpendicular thereto. The hooks 49 are parallel to the flange 41 but extend in an opposite direction thereto.

Figure 3:
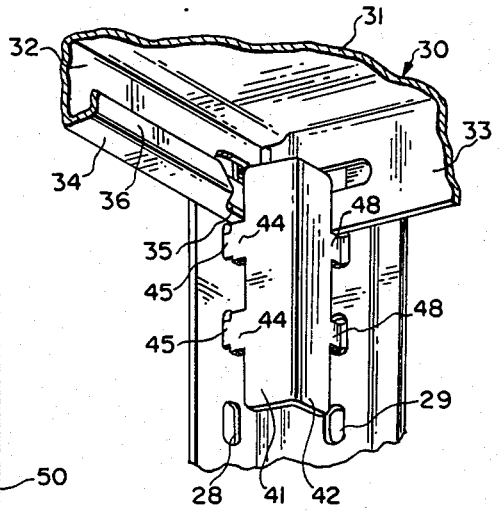
FIG. 3 is a view of the same three components in FIG. 2 but attached together.

Each shelf 30 is mounted by utilizing four of the clips 40 respectively at the corners thereof, as shown in FIG. 3. In this particular embodiment, the distance between the fingers 43 and 48 is the same and is equal to the distance between adjacent apertures 28 and 29 in the post 20.

Figure 4:
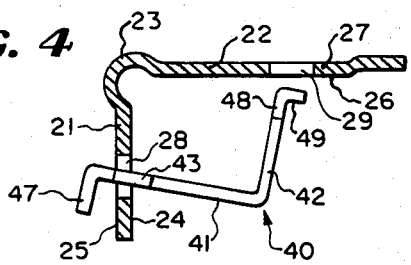
FIGS. 4, 5 and 6 depict stages of attachment of a clip to its associated post.
Figure 5:
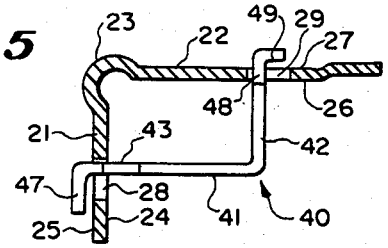
Figure 6:
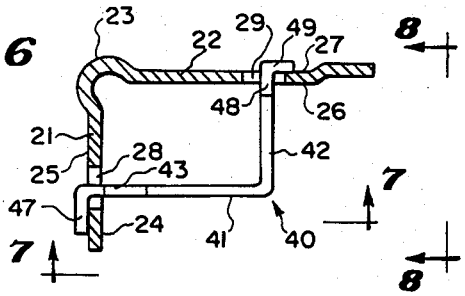

Referring to FIGS. 4, 5 and 6, the manner of assembling each clip 40 to a selected point on one of the posts 20 will be described. The hooks 47 are aligned with a selected pair of apertures 28 in the flange 21 of the post 20 and the clip 40 is skewed somewhat as depicted in FIG. 4. The fingers 43 are inserted into the selected apertures 28 to a point at which the hooks 49 are aligned with corresponding apertures 29 in the post flange 22. As depicted in FIG. 5, the clip 40 is then rotated so that the hooks 49 enter the aligned apertures 29. The clip is then moved away from the post flange 21 until the hooks 47 are disposed against the outer surface 25 of the post flange 21, as shown in FIG. 6. Then, the hooks 49 will be disposed against the outer surface 27 of the post flange 22. Then, the clip is dropped down slightly so that the fingers 48 respectively rest on the bottoms of the apertures 29, and the neck portions 45 respectively rest on the bottoms of the apertures 28. The lower shoulder 46 of each finger 43 faces the inner surface 24 of the post flange 21 so as to limit movement of the clip 40 toward the flange 21 (FIG. 7).

In this condition, the distance between the inner surface 24 of the post flange 21 and the facing edge of the clip 40 substantially equals the width of the lip 35. The distance between the inner surface 26 of the post flange 22 and the facing edge of the clip 40 substantially equals the thickness of the shelf flange 33. The other three clips 40 are similarly applied to the other four posts at the same vertical position.

A shelf 30 is then dropped into place. As shown in FIG. 7, the lip 35 rests on the body portion 44 of the upper one of the fingers 43, and the shelf flange 32 abuts against the inner surface 24 of the post flange 21. The tendency of the clip 40 to be urged away from the post flange 21 is limited by the finger 43 bearing against the outer surface 24 of the post flange 21. Thus, the flange 32 and the lip 35 are held snugly between the post flange 21 and the clip 40. As shown in FIG. 8, the shelf flange 33 rests on the finger 48 and is snugly disposed between the inner surface 26 of the post flange 22 and the clip 40. The tendency of the clip 40 to be urged away from the post flange 22 is limited by the hook 49 bearing against the outer surface 27. The other three corners of the shelf 30 are similarly dropped into place on their associated clips 40.

Despite the fact that the adjacent ends of the shelf flanges 32 and 33 are not attached together, as can be seen in FIG. 2, the clip 40 in association with the post 20 has the effect of these flanges being interconnected.

The clip 40 is longitudinally symmetrical about a plane drawn through its center so that the same clip 40 can be inverted depending upon the particular post orientation within which it is used.

The shelf 30 is supported at each corner thereof, not at one point, but at two points. Also, this construction insures that the posts 20 will be vertical when all the parts are assembled.

To detach a clip 40 from its associated post, it is lifted slightly and the reverse process just described is performed. The clip 40 is moved toward the post flange 21 until the hooks 49 are aligned with the associated apertures 29, whereupon the clip 40 is rotated and the clip 40 is moved away from the post flange 22, thereby withdrawing the fingers 43 and the hooks 47 carried thereby from the apertures 29. The clip 40 is then moved away from the flange 21.

When the shelf 30 is in position, the clips 40 cannot accidentally become disengaged. The shelf 30 must be removed first to enable the clip 40 to be raised in order to disassemble.

The hooks 47 and 49 bear against the respective outer surfaces of the post flanges as the shelf 30 becomes loaded in use so as to prevent unintentional disengagement. Also, each shelf 30 is maintained tightly against four posts 20 so as to minimize twisting of the posts as the shelf is loaded.

What has been described, therefore, is an improved shelving structure and a clip used therein in which the parts are very securely held together with a minimum of time and effort in assembly and disassembly. While a specific embodiment has been described, it is to be understood that various changes can be made without departing from the invention as defined in the claims.

I claim:

1. A clip for mounting a shelf on an upright post, said clip being of one-piece construction and comprising first and second flanges substantially perpendicular to each other, a pair of first fingers coplanar with said first flange and extending outwardly therefrom, a pair of first coplanar hooks carried respectively by said first fingers and being substantially perpendicular thereto, a pair of second fingers coplanar with said second flange and extending outwardly therefrom, and a pair of second coplanar hooks carried respectively by said second fingers and being substantially perpendicular thereto.

2. The clip of claim 1, wherein the width of each of said first and second fingers is substantially less than the length of each of said first and second flanges.

3. The clip of claim 1, wherein each of said first fingers has a wider body portion extending from said first flange and a narrower neck portion extending from said body portion.

4. The clip of claim 3, wherein each of said first hooks has a width substantially the same as each of said neck portions.

5. The clip of claim 1, wherein each of said first flanges has substantially the same width as each of said second flanges.

6. The clip of claim 1, wherein said first fingers are respectively laterally aligned with said second fingers.

7. The clip of claim 1, wherein said first fingers are longer than said second fingers.

8. The clip of claim 1, wherein the distance between one of said first fingers and the adjacent end of said first flange is substantially the same as the distance between the other of said fingers and the other end of said first flange.

9. The clip of claim 1, wherein said first fingers are respectively spaced from the respective ends of said first flange.

10. The clip of claim 1, wherein said first hook extends in a direction opposite to the direction of said second flange, and said second hook extends in a direction opposite to the direction of said first flange.

11. The clip of claim 1 being formed of sheet metal.

12. Shelving structure comprising an upright post including substantially perpendicular first and second post flanges, said first post flange having a first column of apertures, said second post flange having a second column of apertures, the apertures in said first column being respectively laterally aligned with corresponding apertures in said second column, each of said post flanges having an inner surface and an outer surface; a clip including first and second clip flanges substantially perpendicular to each other, a pair of first fingers coplanar with said first clip flange and extending outwardly therefrom, a pair of first coplanar hooks carried respectively by said first fingers and being substantially perpendicular thereto, a pair of second fingers coplanar with said second clip flange and extending outwardly therefrom, a pair of second coplanar hooks carried respectively by said second fingers and being substantially perpendicular thereto, said first fingers being respectively disposed within two of said first apertures, said first hooks facing the outside surface of said first post flange, said first clip flange having an edge spaced from and substantially parallel to the inner surface of said first post flange, said second fingers being respectively disposed within corresponding ones of said second apertures, said second hooks facing the outside surface of said second post flange, said second clip flange having an edge spaced from and substantially parallel to the inner surface of said second post flange; and a shelf including a substantially rectangular top wall and a pair of first shelf flanges depending from opposite sides of said top wall, and a pair of second flanges depending from the two remaining sides of said top wall, one of said first shelf flanges being disposed in the space between said first post flange and said clip and resting on one of said first fingers, and the adjacent second shelf flange being disposed in the space between said second post flange and said clip and resting on one of said second fingers.

13. The shelving structure of claim 12, wherein said first shelf flanges are not attached to said second shelf flanges.

14. The shelving structure of claim 12, wherein said shelf further includes an inturned lip on each of said first shelf flanges, the width of said lip being substantially equal to the space between said first post flange and said clip, whereby said shelf is snugly held in said last-mentioned space.

15. The shelving structure of claim 12, wherein the thickness of said second flange is substantially equal to the space between said second post flange and said clip, whereby said shelf is snugly held in said last-mentioned space.

16. The shelving structure of claim 12, wherein said apertures are elongated, the length of each of said apertures being greater than the length of each of said hooks, and the width of each of said apertures being greater than the width of each of said hooks.

17. The shelving structure of claim 12, wherein each of said first fingers has a wider body portion extending from said first clip flange and a narrower neck portion extending from said body portion, whereby said body portion has a shoulder thereon for engaging the inner surface of said first post flange.

18. The shelving structure of claim 12, wherein the distance between said first fingers equals the distance between two adjacent apertures in said first post flange, and the distance between said second fingers equals the distance between two adjacent apertures in said second post flange.

19. The shelving structure of claim 12, wherein the distance between the corner of said post flange and said first apertures is less than the distance between said corner and said second apertures.

20. Shelving structure comprising a plurality of upright posts, each upright post including substantially perpendicular first and second post flanges, said first post flange having a first column of apertures, said second post flange having a first column of apertures, the apertures in said first column being respectively laterally aligned with corresponding apertures in said second column, each of said post flanges having an inner and an outer surface; a plurality of clips, each clip including first and second clip flanges substantially perpendicular to each other, a pair of first fingers coplanar with said first clip flange and extending outwardly therefrom, a pair of first coplanar hooks carried respectively by said first fingers and being substantially perpendicular thereto, a pair of second fingers coplanar with said second clip flange and extending outwardly therefrom, a pair of second coplanar hooks carried respectively by said second fingers and being substantially perpendicular thereto, said first fingers being respectively disposed within two of the first apertures of the associated post, said first hooks facing the outside surface of the first post flange of the associated post, said first clip flange having an edge spaced from and substantially parallel to the inner surface of the first post flange of the associated post, said second fingers being respectively disposed within corresponding ones of the second apertures of the associated post, said second hooks facing the outside surface of the second post flange of the associated post, said second clip flange having an edge spaced from and substantially parallel to the inner surface of the second post flange of the associated post; and a plurality of shelves, each shelf including a substantially rectangular top wall and a pair of first shelf flanges depending from opposite sides of said top wall, and a pair of second flanges depending from the two remaining sides of said top wall, one of said first shelf flanges being disposed in the space between the first post flange of the associated post and the associated clip and resting on one of the fingers thereof, and the adjacent second shelf flange of the associated shelf being disposed in the space between the second post flange of the associated post and the associated clip and resting on one of such second fingers thereof.

* * * * *

UNITED STATES PATENT AND TRADEMARK OFFICE

CERTIFICATE OF CORRECTION

PATENT NO. : 4,513,669

DATED : April 30, 1985

INVENTOR(S) : Mark H. Steinke

It is certified that error appears in the above-identified patent and that said Letters Patent is hereby corrected as shown below:

Column 6, line 40, "first" should be --second--.

Signed and Sealed this

*Third* Day of *September 1985*

[SEAL]

*Attest:*

DONALD J. QUIGG

*Attesting Officer* *Acting Commissioner of Patents and Trademarks - Designate*